US006192105B1

(12) United States Patent
Hunter et al.

(10) Patent No.: US 6,192,105 B1
(45) Date of Patent: Feb. 20, 2001

(54) METHOD AND DEVICE TO CALIBRATE AN AUTOMATIC EXPOSURE CONTROL DEVICE IN AN X-RAY IMAGING SYSTEM

(75) Inventors: David MacKenzie Hunter; Michael L.G. Joy, both of Toronto (CA)

(73) Assignee: Communications & Power Industries Canada Inc., Georgetown (CA)

( * ) Notice: Under 35 U.S.C. 154(b), the term of this patent shall be extended for 0 days.

(21) Appl. No.: 09/199,154

(22) Filed: Nov. 25, 1998

(51) Int. Cl.[7] ..... H05G 1/44
(52) U.S. Cl. ..... 378/108
(58) Field of Search ..... 378/108, 62, 102

(56) References Cited

U.S. PATENT DOCUMENTS

| | | | | |
|---|---|---|---|---|
| 3,894,235 | | 7/1975 | Franke . | |
| 3,911,273 | | 10/1975 | Franke . | |
| 3,995,161 | | 11/1976 | Lux . | |
| 4,053,774 | | 10/1977 | Berdahl . | |
| 4,394,737 | * | 7/1983 | Komaki et al. | 364/414 |
| 4,454,606 | | 6/1984 | Relihan . | |
| 4,748,648 | | 5/1988 | Boucle et al. . | |
| 4,763,343 | | 8/1988 | Yanaki . | |
| 5,084,911 | | 1/1992 | Sezan et al. . | |
| 5,179,582 | | 1/1993 | Keller et al. . | |
| 5,218,625 | | 6/1993 | Heidsieck . | |
| 5,267,295 | | 11/1993 | Strömmer . | |
| 5,371,777 | | 12/1994 | Koehler et al. . | |
| 5,485,501 | | 1/1996 | Aichinger . | |
| 5,544,157 | | 8/1996 | Wenstrup et al. . | |
| 5,565,678 | | 10/1996 | Manian . | |
| 5,664,000 | | 9/1997 | Van Woezik et al. . | |
| 5,751,783 | | 5/1998 | Granfors et al. . | |
| 6,047,042 | * | 4/2000 | Khutoryansky et al. | 378/62 |

* cited by examiner

*Primary Examiner*—David V. Bruce
*Assistant Examiner*—Pamela R. Hobden
(74) *Attorney, Agent, or Firm*—Riches, McKenzie & Herbert, LLP; Jeffrey Pervanas

(57) ABSTRACT

A method and device to calibrate an automatic exposure control (AEC) device in an x-ray imaging system is disclosed. An x-ray imaging system has an x-ray generator and tube to generate x-rays, an AEC device to control exposure of the x-rays, and an image sensing system, such as a film/screen combination or a digital recording system, which convert the x-rays into a converted medium, such as light, which can be easily sensed by a sensing medium. To calibrate the AEC device, a detector is placed in the position of the sensing medium to detect the converted medium. The detector detects signals indicative of the x-rays on a sensing medium. Simultaneously, a signal is obtained from the AEC. When the signal from the detector corresponds to a predetermined desired detector output, the output signal from the AEC is stored. The stored AEC output value corresponds to the target AEC output which will produce a proper exposure in the future for the same set of predetermined conditions of the imaging system. The process is repeated for different sets of predetermined conditions until all of the desired sets of predetermined conditions have been calibrated. There is a preliminary step to determine the desired detector output. This preliminary step comprises fixing an attenuation filter about the sensing means, which has graded attenuations, and placing these in the imaging system along with a detector. The x-ray generator then generates x-rays and the desired detector output is determined by comparing the attenuation caused by the attenuation filter with detected signal.

22 Claims, 7 Drawing Sheets

METHOD AND DEVICE TO CALIBRATE AN AUTOMATIC EXPOSURE CONTROL DEVICE IN AN X-RAY IMAGING SYSTEM

FIELD OF THE INVENTION

This invention relates to x-ray imaging systems using automatic exposure control devices. More particularly, this invention relates to a method and device to assist in calibrating automatic exposure control devices used in x-ray imaging systems.

BACKGROUND OF THE INVENTION

It is known in the art to use an automatic exposure control (AEC) device to control the exposure of x-rays in an x-ray imaging system. An AEC device is generally placed after the subject being imaged and prior to the imaging cassette or detector, although it may also be placed after the cassette or detector. The purpose of the AEC device is to sense a small fraction of the x-rays which have passed through the patient and generate an electrical signal indicative of the x-ray exposure of the imaging cassette or detector. Once the correct x-ray exposure is obtained, as determined from the AEC signal, the exposure is terminated.

It is important in diagnostic x-ray imaging to produce images with a consistent optical density or image quality so that a more accurate diagnosis can be made. Consistent optical density or image quality is also important so that accurate comparisons can be made to previous images.

It is known in the art to record an x-ray image on a film by placing the film in a cassette having at least one phosphor screen, and preferably two phosphor screens, with a double emulsion film sandwiched between the two screens. The screens may be of different thicknesses. The phosphor screens emit light fluorescently in response to x-rays, thereby converting the x-ray image into another medium, namely light. The fluorescent light emitted by the phosphor screen is recorded on the film, thereby recording the x-ray image.

The signal from the AEC device is related to the fluorescent light exposure of the film in the cassette or on the detector in a complicated manner. AEC devices are typically comprised of ion chambers or thin solid-state x-ray detectors. There may be one, two, three or more fields in an AEC device. The response of AEC devices to x-ray radiation differs considerably from that of screen/film systems or digital detectors. The AEC device must have a low quantum efficiency ("QE") so that a very small fraction of the x-ray radiation is absorbed by the AEC device, intercepting but a very small fraction of the x-ray radiation, since any intercepted radiation does not contribute to the final image and leads to increased patient exposure. Also, by intercepting a small amount of the image radiation, it is less likely that a noticeable image of the AEC detector will appear in the final radiograph.

The low QE requirement of the AEC detector typically results in an AEC detector design which has a response to x-ray radiation which is different than the imaging sensing and recording device. Therefore, the AEC detector response varies differently to changing x-ray conditions than the image sensing device. For example, the x-ray spectrum changes due to a change in x-ray tube voltage (kV) and changes in the patient anatomy and thickness. Hence, it is necessary to accurately calibrate the AEC device to determine a correct and consistent relationship between the x-rays being detected by the AEC device and the desired fluorescent light exposure of the screen/film combination or digital detector. More particularly, the calibration procedure will result in data indicating the desired output signal of the AEC device which corresponds to a desired optical density and image quality or digital signal for the particular conditions, such as generator kV, patient anatomy and/or thickness, screen/film combination and film processor speed.

In the past, AEC devices have been calibrated using a tedious trial and error approach. Because the exposure on a film will depend on several variables, such as the x-ray generator kV, the patient anatomy and/or thickness, the screen/film combination and the film processor speed, several different exposures involving development of several films or digital images is required to properly calibrate the AEC device for each of the variables. In addition, the screen/film combination must be calibrated in each receptor where it may be located, such as in the table or on the wall. An imaging system may have more than one, such as four, receptors. This process can take many hours to complete for each different combination of x-ray generator kV, patient thickness, screen/film combination and film processor speed. Also, the AEC device must be recalibrated each time there is a change in one or more of the variables of the x-ray imaging system, such as a change in the screens or films used, installation of a new x-ray generator, replacement of the x-ray tube, a grid change or a change to the added filtration in the x-ray collimator.

Therefore, while AEC devices are useful in automatically obtaining the proper exposure for films, the prior art method for calibrating the AEC device is tedious, time consuming, and requires exposing and developing several films, on the order of fifty or more. This all increases the cost of installation and calibration and also decreases the amount of time the x-ray imaging system is available for imaging.

In addition to film/screen x-ray imaging systems, there is a move towards digital recording x-ray imaging systems. In digital recording systems, the x-ray image is recorded in a digital or electronic form. One class of digital systems include Cesium Iodide or phosphor screen systems which convert the x-rays to light. These classes of digital systems utilize a variety of image sensing devices, such as (1) direct optical coupling to active matrix thin film transistor (TFT) switching arrays having a photodiode or other light sensing means at each matrix position (flat panels), (2) charge coupled devices (CCDs) or (3) integrated CMOS detector technology devices. Direct optical coupling generally has no magnification factor while charge coupled devices and integrated CMOS detector technology devices record a magnification reduced light image after it has been optically coupled to the sensors via lenses or fibre-optics. A further class of digital systems include photostimuable phosphor systems wherein the x-ray image is captured as a latent image on a storage phosphor plate which can then be readout by a laser scanning device. Other classes of digital systems may utilize x-ray sensitive photoconductors such as amorphous selenium or lead oxide to convert the x-ray image directly into an electric charge which can then be directly sensed, recorded and transferred electronically using TFTs, diode switching arrays, or, readout by laser scanning methods.

As the digital recording systems also utilize AEC devices to control x-ray exposure, the digital recording systems must also be calibrated and optimized to give radiographs that yield the proper image quality and x-ray exposure levels. This process may involve a careful adjustment that relates the response of the AEC device signal to the response of the digital detector which detects the converted medium, whether it is light, an electric charge, or another medium.

Accordingly, there is a need in the art for an improved method and device to automatically and efficiently calibrate AEC devices. Furthermore, there is a need in the art for a method and device to calibrate AEC devices which does not require a large number of exposures, radiation level measurements, and the development of a large number of films or sequencing of digital images.

SUMMARY OF THE INVENTION

Accordingly, it is an object of this invention to at least partially overcome the disadvantages of the prior art. Also, it is an object of this invention to provide an improved type of device and method to automatically calibrate AEC devices. Furthermore, it is an object of the present invention to provide a method and device to more quickly calibrate AEC devices without the need to make a large number of x-ray films, x-ray exposures or radiation level measurements.

Accordingly, in one of its aspects, this invention resides in a device for calibrating an automated exposure control (AEC) device in an x-ray imaging system, said AEC device generating an AEC output signal and said x-ray imaging system comprising an x-ray generating device for generating x-rays and screen means for converting x-rays into light which can be sensed by photosensitive films in an image sensing location, said device for calibrating comprising: photodetector means for detecting light in the image sensing location and generating a detector signal indicative of the light being detected; determining means for receiving the detector signal and the AEC output signal and determining if the detector signal corresponds to a desired detector output; and wherein the photodetector means detects light generated by the screen means when the x-ray generating device is generating x-rays; wherein, for a first set of predetermined conditions of the imaging system, the x-ray generating device generates x-rays and the determining means determines a first target AEC output which corresponds to the AEC output signal which is generated by the AEC device when the detector signal corresponds to the desired detector output; and wherein the first target AEC output corresponds to the AEC output signal for a proper exposure of photosensitive films when the imaging system has the first set of predetermined conditions.

In a further aspect, the present invention resides in an x-ray imaging system comprising an x-ray generating device to generate x-rays, an automated exposure control (AEC) device having x-ray detector means for detecting x-rays and generating an AEC output indicative of the x-rays detected, and converting means for converting x-rays to a converted medium which can be sensed by image sensing means when in an image sensing location, a method for calibrating said AEC device comprising the steps of: (a) generating x-rays with said x-ray generator when the imaging system has a first set of predetermined conditions; (b) detecting the converted medium in the image sensing location and generating a detector signal indicative of the converted medium being detected in the imaging sensing location; (c) determining when the detector signal corresponds to a desired detector output; and (d) determining a target AEC output for the first set of predetermined conditions corresponding to the AEC output when the detected output corresponds to the desired detector output.

In a still further aspect, the present invention resides in an x-ray imaging system comprising an x-ray generating device to generate x-rays, an automated exposure control (AEC) device having x-ray detector means for detecting x-rays and generating an AEC output signal indicative of the x-rays detected, and converting means for converting x-rays into a converted medium which can be sensed by image sensing means in an image sensing location, a device for calibrating said AEC device comprising: detector means for detecting the converted medium in said image sensing location and generating a detector signal indicative of the converted medium being detected in the image sensing position; and determining means for receiving the detector signal and the AEC output signal and determining a first target AEC output signal for a first set of conditions of the imaging system by determining the AEC output signal when the detector output corresponds to a desired detector output and the x-ray imaging system has the first set of conditions.

Accordingly, one advantage of the present method and device is that an AEC device can be calibrated with a minimal number of x-ray exposures and/or radiation level measurements. A further advantage of the present method and device is that in x-ray imaging systems utilizing films, a minimal number of films need be developed. Furthermore, the method can be implemented through computer hardware and software to automatically calibrate the AEC device, thereby decreasing the time required by highly trained professionals to perform the calibration process and also decreasing the likelihood of human error in the calibration process. In addition, by decreasing the time required to calibrate the AEC device, the present method and device increases the overall time x-ray imaging systems are available for imaging.

A further advantage of the present invention is that the present method and device can be used in existing x-ray imaging systems to calibrate the existing devices. In other words, the present method and device can be retrofitted onto existing x-ray image devices and used in association with them. A still further advantage of the present invention is that the present method and device can be used to calibrate x-ray imaging systems utilizing different recording systems, such as film and digital systems.

A further advantage of the present invention is that it allows continuous quality control of the x-ray imaging device and film cassettes (screens/films) at a given installation.

Further aspects of the invention will become apparent upon reading the following detailed description and drawings which illustrate the invention and preferred embodiments of the invention.

BRIEF DESCRIPTION OF THE DRAWINGS

In the drawings, which illustrate embodiments of the invention.

DETAILED DESCRIPTION OF THE PREFERRED EMBODIMENTS

Figure 1:
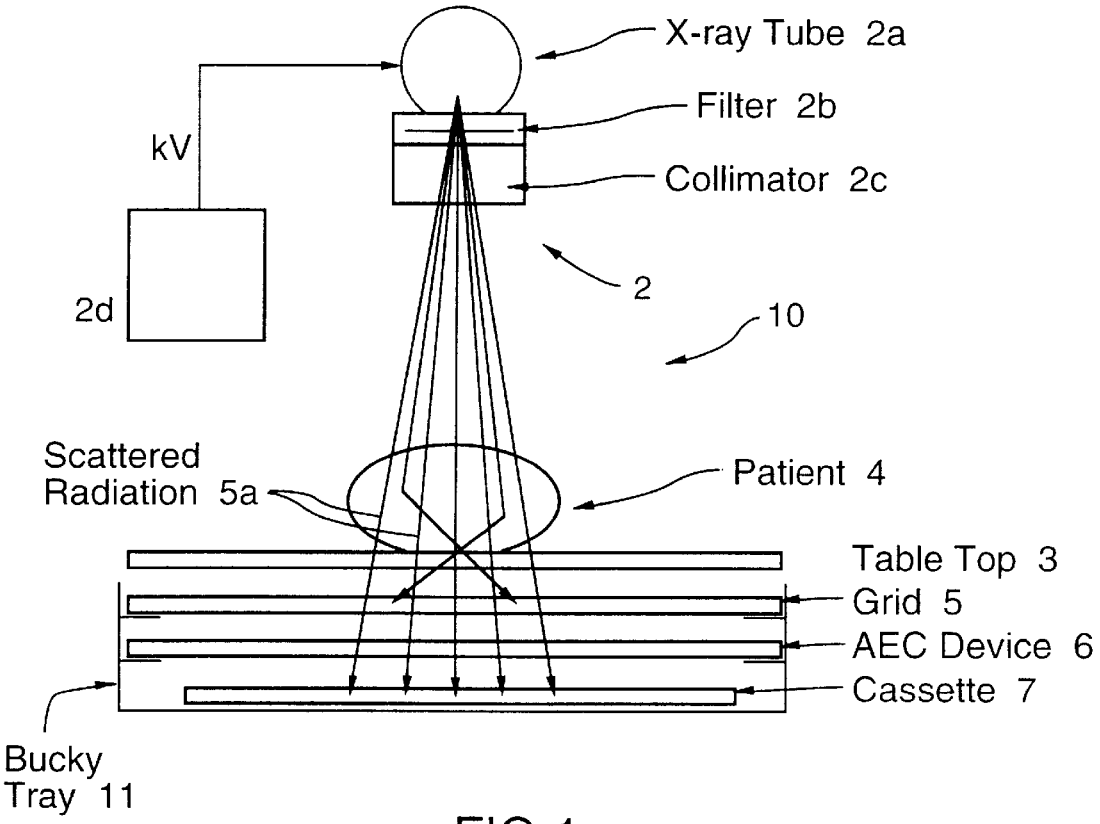
FIG. 1 is a schematic diagram of a conventional x-ray imaging system to record x-ray images.

FIG. 1 shows a schematic diagram of an x-ray imaging system, shown generally by reference numeral 10. The x-ray imaging system 10 comprises an x-ray generating device 2 to generate x-rays, as is known in the art. The x-ray generating device 2 comprises a tube 2*a* connected to an x-ray generator 2*d*. The tube 2*a* generally has a cathode filament which is heated to allow emission of electrons from the filament. The x-ray generator 2*d* then applies a voltage kV between the cathode filament and an anode. The applied voltage kV causes the electrons to accelerate and strike the anode. High speed electrons striking the anode generate the x-rays.

The x-ray generating device 2 further comprises a filter 2*b* and a collimator 2*c*. The filter 2*b* is used to filter some of the x-rays and the collimator 2*c* collimates the x-rays.

X-rays generated by the x-ray generating device 2 travel towards a patient 4. In FIG. 1, the patient 4 is shown on a table top 3, but it is understood that the patient 4 could be in another position or location.

Upon exiting the patient 4, the x-rays, in the embodiment shown in FIG. 1, pass through the table top 3 and into the bucky tray 11. The bucky tray 11 comprises the AEC device 6 and a cassette 7.

Figure 2:
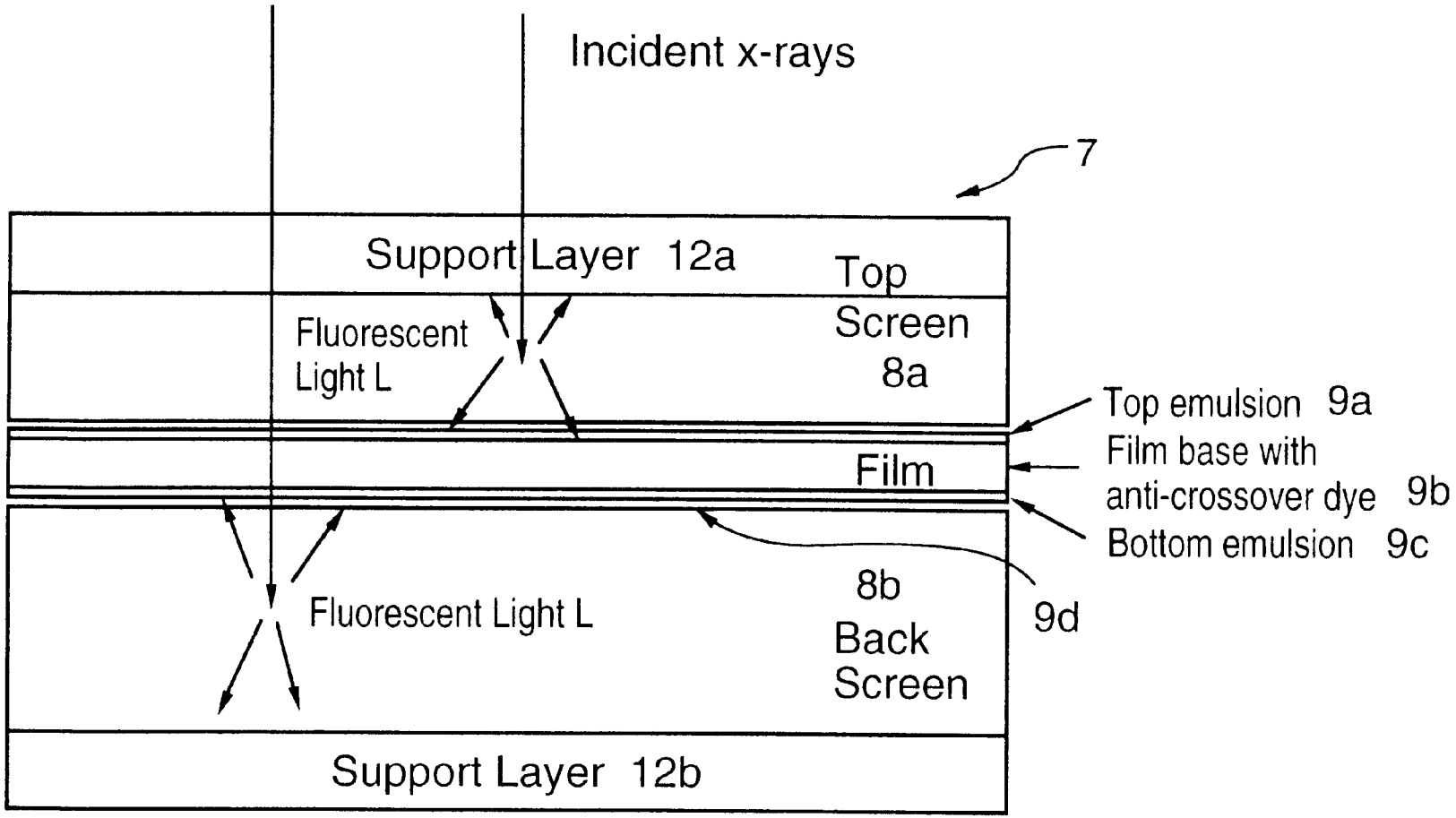
FIG. 2 is a diagram of a film cassette used in conventional x-ray imaging systems.

The cassette 7 can comprise any devices capable of converting the x-rays to a more useful medium, such as light, and then sensing the converted image. In one embodiment, as shown in FIG. 2, the cassette 7 comprises a top phosphor screen 8*a* and a back phosphor screen 8*b* to convert the incident x-rays into fluorescent light L. The fluorescent light L is then sensed and recorded by a film 9. The film 9 preferably has a top emulsion 9*a*, a bottom elusion 9*c* and a film base with anti-crossover dye 9*b* in between. FIG. 2 shows the film 9 in the image sensing location 9*d*, which is the location where the image can be sensed, such as between the top screens 8*a* and bottom screens 8*b* where fluorescent light L from both screens 8*a*, 8*b* can be sensed and/or image recorded. The term "top", in reference to the screen 8*a* and emulsion 9*a*, is understood to mean the screen 8*a* and the emulsion 9*a* which are closer to source of incident x-rays. Likewise the term "bottom" is understood to refer to the screen 8*b* and emulsion 9*c* which is further from the incident x-rays. The cassette 7 can also comprise support layers 12*a*, 12*b* to support the screens 8*a*, 8*b* and film 9 and seal the film 9 from external light.

In further embodiments, the converting device could be phosphor screens, including Calcium Tungstate and rare earths, or Cesium Iodide screens to convert the x-ray image into light and image sensing devices such as TFTs having photodiodes or other light sensing devices at each matrix position to sense and record the resulting light image. In a further embodiment, the converting device could comprise photoconductors, such as selenium receptor or lead oxide which convert the x-ray image into electrical charges that can then be directly sensed, recorded and transferred electronically using TFTs or readout by laser scanning methods.

As the rays interact with the patient 4, the x-rays scatter and are attenuated such that the x-ray image is a shadow of the internal anatomy of the patient 4. The bucky tray 11 may also comprise a grid 5 such that, before the x-rays reach the cassette 7, the x-rays may pass through the grid 5 which absorbs the majority of the scattered x-ray radiation, shown generally by reference numeral 5*a* in FIG. 1. Scattered radiation 5*a* does not directly contribute to a useful x-ray image, but rather only the x-ray radiation that has not interacted with the patient 4 contributes to a useful x-ray image.

Upon passing through the grid 5, the x-rays interact with the automatic exposure control (AEC) device 6 which uses weakly absorbing x-ray detectors to sense the x-rays, while not noticeably interfering with the x-ray image. The AEC device 6 generates an AEC output signal $V_{AEC}$ indicative of the x-rays sensed by the AEC device 6. Once sufficient x-rays have passed through the patient 4 and the grid 5 so as to produce a proper film darkness on the film 9, or proper response of a digital detector, the x-ray generating device 2 stops generating x-rays.

In order to determine if sufficient x-rays have passed through the imaging system 10 to the cassette 7, the AEC output $V_{AEC}$ must be calibrated by determining a target AEC output $T_{AEC}$ for each of the sets of predetermined conditions of the imaging system 10. There are several variables that affect the set of predetermined conditions for the imaging system 10 as referred to above and including phosphor screens 8*a*, 8*b* and film 9 combination used as different films and different screens react differently to x-rays, the patient thickness or anatomy which would affect the attenuation and spectrum of the x-rays, the x-ray generator voltage kV used to generate the x-rays, the x-ray generator 2*d* and x-ray tube 2*a* being used, the x-ray filter 2*b* and collimator 2*c* and the grid 5.

It is apparent that an imaging system 10 could have a plurality of sets of predetermined conditions representing different values for each of these variables. Accordingly, the system 10 must be calibrated to determine the correct or target AEC output $T_{AEC}$ which will result in the proper exposure of the film 9, or other image sensing device, for each set of predetermined conditions.

During the calibration procedure, the x-ray imaging system 10 will have its various variables set to a first predetermined condition and the x-ray generating device 2 will generate x-rays for a predetermined time period. As several x-ray exposures will be required to calibrate the imaging system 10 for all of the conditions, an x-ray absorbing medium, which is generally a copper plate or water, will be used to mimic the attenuation of the patient 4. Various copper plates of different thicknesses will generally be used during the calibration process to mimic the attenuation caused by different thicknesses, and different parts of the anatomy, of the patient 4.

Figure 3A:
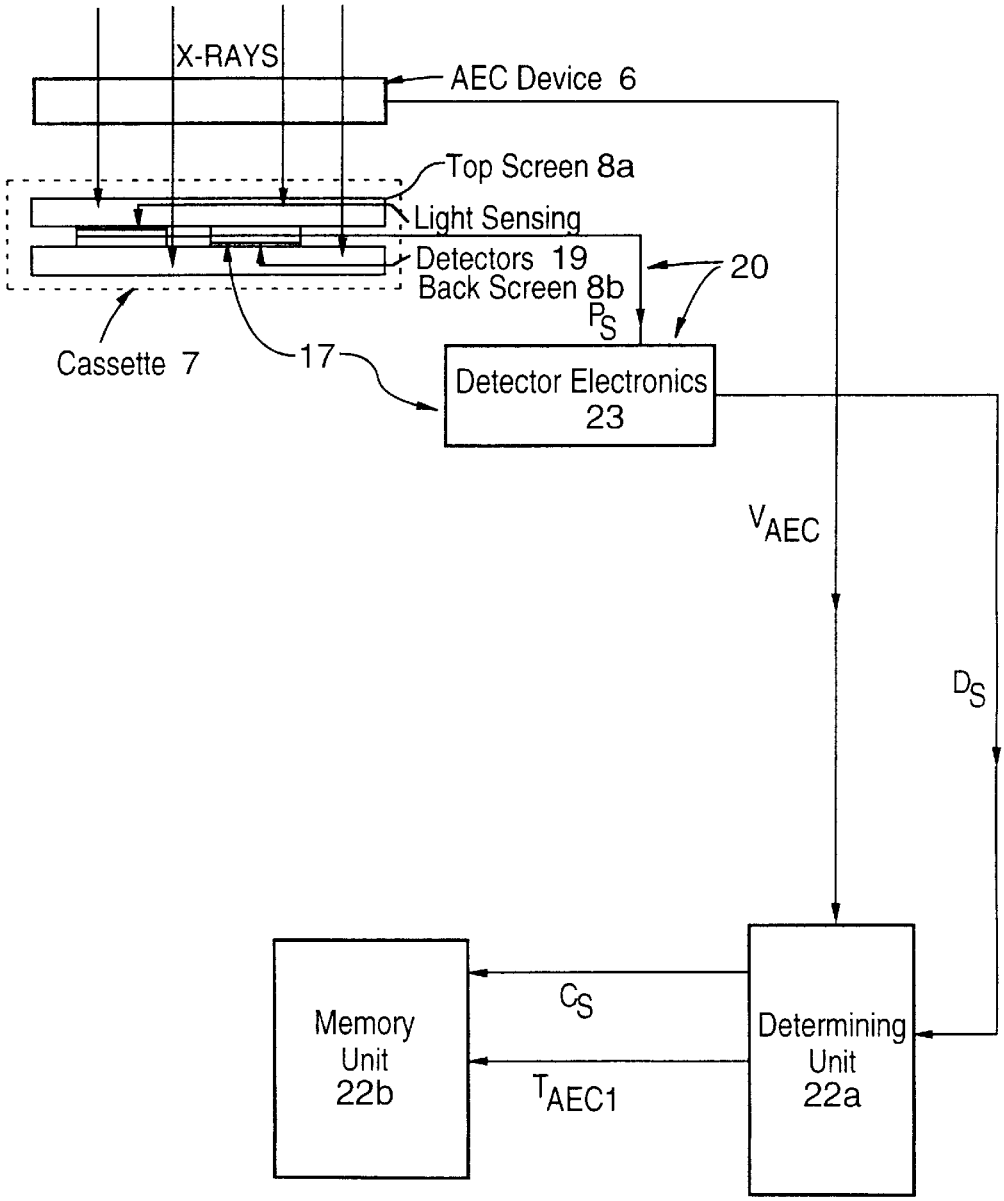
FIG. 3*a* is a diagram of a device according to one embodiment of the present invention for use in association with a film/screen x-ray imaging system.

FIG. 3*a* shows a block diagram of a device, shown generally by reference numeral 20, to facilitate calibrating the AEC device 6 in the image system 10 according to one embodiment of the invention. As shown in FIG. 3*a*, the device 20 comprises a detector unit, shown generally by reference numeral 17, for detecting the medium to which the x-rays have been converted. In the embodiment shown in FIG. 3*a*, the imaging system 2 utilizes a cassette 7 having phosphor screens 8*a*, 8*b* for converting the x-rays into light, which is then sensed by photosensitive film, such as the film shown in FIG. 2 by reference numeral 9. Accordingly, because the x-rays are converted by the screens 8*a*, 8*b* to light, the detector unit 17 in the embodiment shown in FIG. 3*a* will comprise photodetectors 19, or other light sensing detectors, to sense the converted medium. The photodetectors 19 detect the fluorescent light L generated by the screens 8*a*, 8*b* in the cassette 7, and preferably in the imaging sensing position 9*d*, while the x-ray generating device 2 is generating x-rays. The photodetectors 19 generate photodetector signals $P_S$ indicative of the light being detected in the cassette 7. In the case where the converted medium is a medium other than light, such as electrical charge, the detector unit 17 will comprise a detector to sense the other converted medium.

The detector unit 17 also comprises detector electronics 23 which receive the photodetector signals $P_S$ from the photodetectors 19 and process the photodetector signal $P_S$ to a detector signal $D_S$ which is received by the determining unit 22*a*. Accordingly, the photodetectors 19 detect the light generated by the screens 8*a*, 8*b* in the image sensing position 9*d* where a film 9 would be located during an actual exposure and send a photodetector signal $P_S$ to the detector electronics 23. The photodetector signal $P_S$ from the photodetectors 19 is then processed by the detector electronics 23 to produce a detector signal $D_S$ which is indicative of the light being detected by the photodetectors 19. The detector signal $D_S$ could be an analog or digital signal representing the integrated exposure of light, or, a signal indicating that the integrated exposure of light has achieved a predetermined value, such as a desired detector signal $DD_S$.

While a single photodetector 19 could be used, as the embodiment shown in FIG. 3*a* utilizes two screens 8*a*, 8*b*, it is preferable that at least two photodetectors 19 be used to sense the light being emitted by each of the screens 8*a*, 8*b*. The detector electronics 23 may generate the detector signal $D_S$ from an average of the photodetector signals $P_S$ received from each of the photodetectors 19, or, the detector electronics 23 may generate the detector signal $D_S$ from each of the photodetector signals $P_S$, or a combination of both, depending on the user's preference and the specific algorithm contained within the determining unit 22*a*.

The determining unit 22*a* then determines a first target $T_{AEC1}$ output which corresponds to the $V_{AEC}$ output signal which is generated by the AEC device 6 when the detector signal $D_S$ corresponds to a desired detector output signal $DD_S$. The calibrating device 20 also preferably comprises a memory unit 22*b* which receives the first target AEC output $T_{AEC1}$, as well as condition signals $C_S$ indicating the first set of predetermined conditions. The memory unit 22*b* then stores the first target AEC output $T_{AEC1}$ in association with the first set of predetermined conditions. In this way, when the x-ray imaging system 10 is used in the future with conditions corresponding to the first set of predetermined conditions, it will be known that a proper exposure of the photosensitive film 9 in the image sensing position 9*d* will have been obtained when the AEC output signal $V_{AEC}$ corresponds to the first target AEC output $T_{AEC1}$ and the x-ray generating device 2 will discontinue generating x-rays.

Once the first target AEC output $T_{AEC1}$ has been determined, the procedure can be repeated for a second set of predetermined conditions to determine a second target output $T_{AEC2}$ for the second set of predetermined conditions. Preferably, as there are a number of different variables which together form the sets of predetermined conditions, only one variable should be changed at each time to more quickly calibrate the AEC device 6 for each of a plurality of sets of predetermined conditions.

In a preferred embodiment, the determining unit 22*a* prompts the users of the calibrating device 20 as to what the predetermined conditions should be. In this way, by following the prompts given by the determining unit 22*a*, the user need not enter data corresponding to each of the plurality of sets of predetermined conditions, but need only indicate that the imaging system 2 corresponds to the set of predetermined conditions being prompted by the determining unit 22*a*, thereby decreasing the time required to calibrate the imaging system 10 and decreasing the likelihood of human error. This can then be repeated for each of a plurality of sets of predetermined conditions until a target AEC output $T_{AEC}$ has been determined for each of the plurality of sets of predetermined conditions the imaging system 10 may have.

Figure 3B:
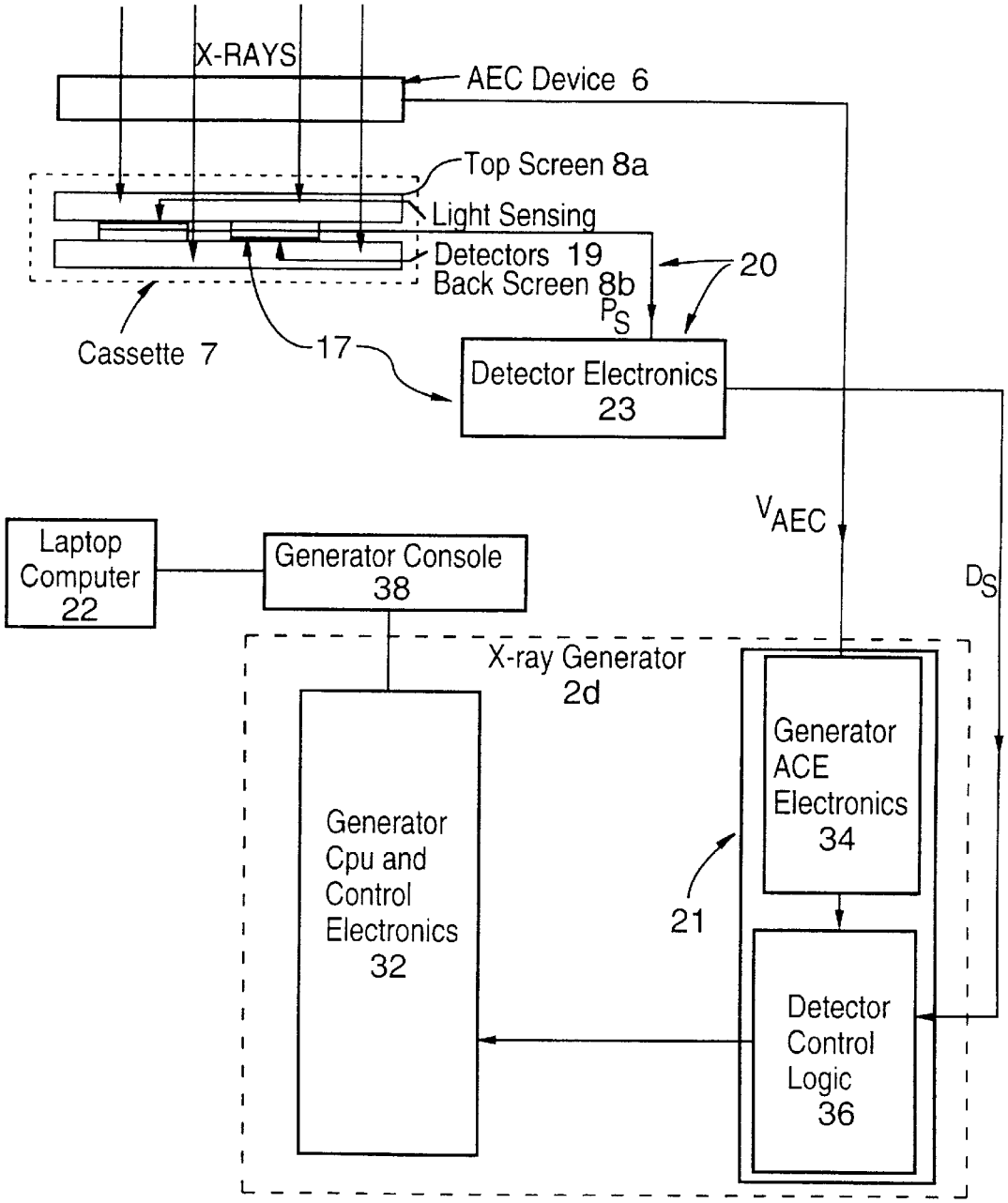
FIG. 3*b* is a diagram of a device according to a further embodiment of the present invention for use in association with a film/screen x-ray imaging system.

FIG. 3*b* shows a further embodiment of the present invention. In FIG. 3*b*, the AEC output signal $V_{AEC}$ is shown being received by the generator AEC electronics 34 of the x-ray generator 2*d*. Likewise, the detected signal $D_S$ is being received by detector control logic 36 located in the x-ray generator 2*d*. The generator AEC electronics 34 and the detector control logic 36 form part of the generator interface 21 in an x-ray generator 2*d*. The AEC output signal $V_{AEC}$ and the detected signal $D_S$ are then sent to the generator CPU and control electronics 32 and to the generator console 38.

One advantage of the embodiment shown in FIG. 3*b* is that the x-ray generator 2*d* generally has generator AEC electronics 34 to receive the AEC output $V_{AEC}$ during normal operation of the x-ray imaging system 10. Accordingly, the embodiment shown in FIG. 3*b* utilizes the same generator AEC electronics 34 and the generator CPU and control electronics 32 to calibrate the system 10 as is used during operation of the system 10. The only additional electronics required is the detector control logic 36 which is placed in the generator interface 21 to receive the detector signal $D_S$.

In the embodiment shown in FIG. 3*b*, the determining means 22*a* and the memory unit 22*b* are combined in a laptop computer 22 which receives the AEC output signal $V_{AEC}$ and the detected signal $D_S$ from the generator console 38. In a further embodiment, the determining means 22*a* and memory unit 22*b*, rather than being located in a separate laptop computer 22, could be integrated with the x-ray generator 2*d*.

It is understood that the desired detector signal $DD_S$ corresponds to the signal from the detector 17 indicating that the detection of the converted medium in the image sensing location will correspond to the level or amount of the converted medium which is sufficient for proper exposure of the image sensing device, such as the film 9. The desired detector signal $DD_S$ could be determined in a number of ways depending on the specific converting device and image sensing device being used.

Figure 4A:
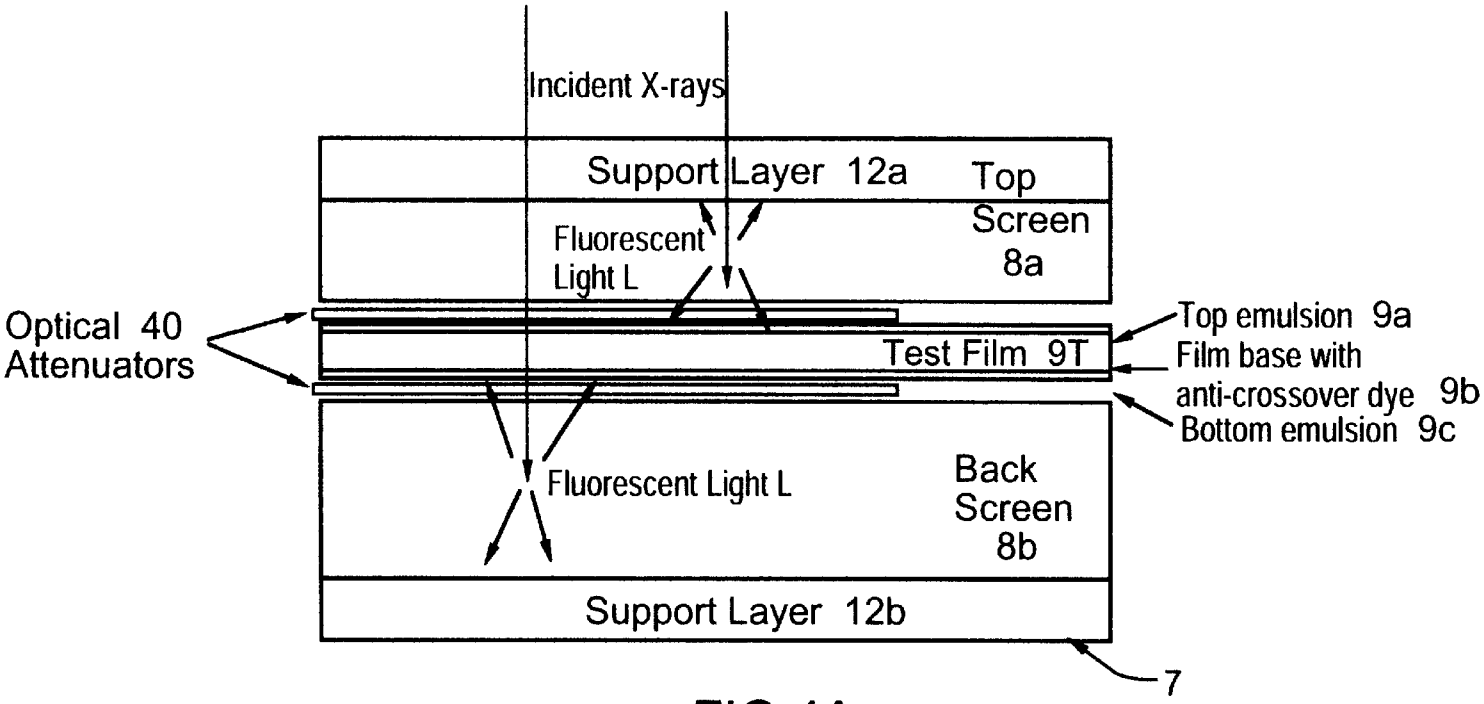
FIG. 4*a* is a diagram of the cassette with a test film according to a further embodiment of the present invention.
Figure 4B:
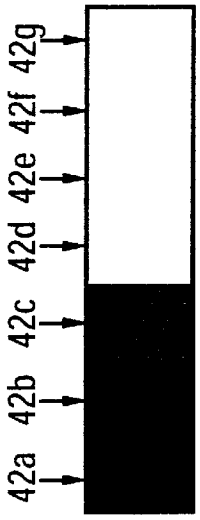
FIG. 4*b* is a top view of an optical attenuator used to determine the desired detector signal according to one embodiment of the present invention.

In the case where the converting device comprises phosphor screens 8*a*, 8*b* and the image sensing device is the photosensitive film 9, the desired detector signal $DD_S$ can be determined by placing a first test film 9T in the cassette 7 between the screens 8*a*, 8*b* with optical attenuators 40 placed on either side of the test film 9T, as shown in FIG. 4*a*. The optical attenuators 40 each comprise different attenuation regions 42*a* to 42*g*, as shown in FIG. 4*b*, having different known levels of attenuation and transmissivity. In the case where a photosensitive film 9 is to be used in the imaging system 2, the attenuators 40 would be optical attenuators and preferably neutral density optical attenuators, but it is understood that if a different converted medium was to be used, such as electrical charge, the attenuator 40 would have an attenuation corresponding to the converted medium.

Once the test film 9T, with the optical attenuator 40, has been placed in the cassette 7, a single x-ray exposure of a known intensity is made. The test film 9T is then developed and optical density measurements are made at the location where the optical attenuator 40 was placed over the test film 9T. Each of the regions of attenuations 42*a* to 42*g* which caused the corresponding darkness on the test film 9T are also measured. This information is then inserted into the determining unit 22*a*. In addition, at least one, and preferably both, photodetectors 19 are exposed to a similar x-ray exposure and the corresponding detector signal $D_S$ is also entered into the determining unit 22*a*. The photodetectors 19 can be exposed to a similar x-ray exposure by either placing the photodetectors 19 in the cassette 7 along with the test film 9T, or, placing the photodetectors 19 in the cassette 7 before or after the test film 9T has been exposed and generating x-rays for a similar exposure. If the photodetectors 19 are placed in the cassette 7 with the test film 9T, it is understood that the test film 9T should not interfere with the photodetector 19 and the test film 9T may be cut if necessary. From this data, namely the film density data, the known optical attenuation data, as well as the known response of the photodetectors 19 to light intensity, and the corresponding detector signal $D_S$ from the photodetectors 19 during a similar x-ray exposure, the desired detector signal $DD_S$ can be determined as follows.

The developed test film 9T is analyzed to determine which two regions, for example 42*c* and 42*d*, of the regions 42*a* to 42*g* produced an optical density on the test film 9T which straddles the desired optical density. The desired transmissivity of the desired optical density is interpolated from the known transmissivities m of regions 42*c* and 42*d*. Using the corresponding transmissivity of the desired optical density, and knowing the corresponding detector signal $D_S$ during a similar x-ray exposure and the photodetector response, the desired detector signal $DD_S$ required to produce the desired optical density is determined. For example, if the transmissivity of the desired region is 0.5, the corresponding detector signal $D_S$ was 2V, and if the photodetector response was linear, the desired detector signal $DD_S$ would be (2V×0.5=) 1V. To save time, if it is easily possible to determine that regions 42*c* and 42*d* straddle the desired optical density, only the transmissivity and optical density for these two regions 42*c* and 42*d* need be entered into the determining unit 22*a*.

Because the desired detector signal $DD_S$ is based on the desired film optical density, the same desired detector signal $DD_S$ can be used for each of the plurality of sets of predetermined conditions. However, if different radiologists have different desired film optical densities, then a different desired detector signal $DD_S$ would be required for each radiologist. And, of course, the system 10 would need to be calibrated for each of the different desired optical densities.

Figure 5:
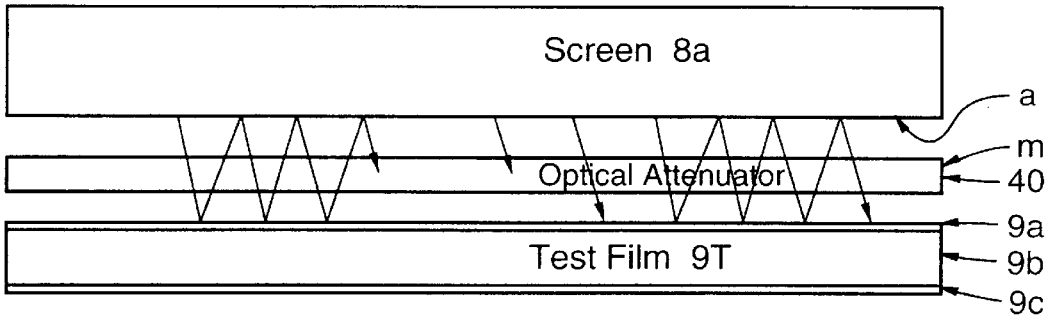
FIG. 5 is a more detailed diagram of the cassette shown in FIG. 4*b* showing the reflection of light between the screens and the test film.

In a preferred embodiment, the attenuation m caused by each region 42*a* to 42*g* of the attenuators 40 is modified to produce an effective attenuation $m_{eff}$ for each of the regions 42*a* to 42*g*. The effective attenuation $m_{eff}$ takes into account reflection of the fluorescent light L within the cassette 7. This is illustrated in FIG. 5 where the top screen, one of the optical attenuators 40 and the test film 9T are shown. The screen 8*a* has a screen reflectivity a and the top emulsion 9*a* of the test film 9T has a film reflectivity b. The optical attenuator transmissivity m of one region 42 of the attenuator 40 is shown generally by the letter m, but it is understood that each of the ranges 42*a* to 42*g* would have a different transmissivity m. Accordingly, the intensity I of fluorescent light L on one side of the test film 9T for the transmissivity m of one of the regions of attenuation 42*a* to 42*g* will be given by the equation $$I(m)=m(1-b)+m^3ab(1-b)+m^5a^2b^2(1-b)+ \quad (1)$$

Equation 1 then reduces to the following:

$$I(m) = m(1-b)\sum_{n=0}^{\infty}(m^2ab)^n = \frac{m(1-b)}{(1-m^2ab)} \quad (2)$$

Therefore, the effects of the reflection of the light will be given by equation (2) when the transmissivity m is equal to 1, indicating no attenuation as follows:

$$I(1) = \frac{(1-b)}{(1-ab)} \quad (3)$$

Therefore, the effective transmissivity $m_{eff}$ will be a ratio of the intensity for a given optical attenuation transmissivity m divided by the intensity when there is no attenuation or m is equal to 1, by the following equation:

$$m_{eff} = \frac{I(m)}{I(1)} = \frac{m(1-ab)}{(1-m^2ab)} \quad (4)$$

Accordingly, using the effective transmissivity $m_{eff}$ for the corresponding region 42*a* to 42*g* of the attenuator 40 will take into account the reflection of the fluorescent light L within the cassette 7 between the surface of the screen 8*a*, 8*b* and the corresponding emulsion surface 9*a*, 9*b*, respectively, of the test film 9T. Therefore, using the effective transmissivity $m_{eff}$ will produce a more accurate desired detector signal $DD_S$.

Figure 6:
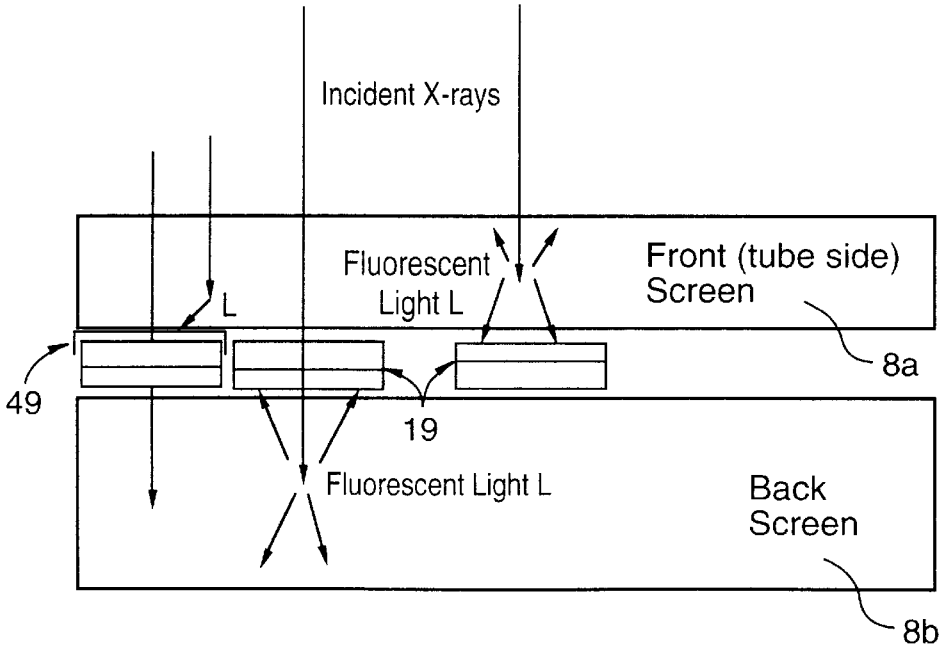
FIG. 6 shows a diagram of a further embodiment of the present invention having an opaque detector which is insensitive to light.

In a further embodiment, an additional opaque photodetector 49, as shown in FIG. 6, can be placed in the cassette 7 along with the photodetectors 19 in the image sensing position 9*d*. The opaque photodetector 49 is made insensitive to the light from the screens 8*a*, 8*b*, for example by covering it with an opaque material. The opaque photodetector 49 is used to determine the effects, if any, of the x-rays, and other factors such as electromagnetic interference, have on the photodetectors 19. The detector electronics 23 receives the opaque photodetector signal $OP_S$ from the opaque detector 49 along with the photodetector signal $P_S$ from the photodetectors 19 and modifies the detector signal $D_S$ to account for the effects of the x-rays and other factors on the detectors 19 as detected by the opaque photodetector 19. The detector electronics 23 accomplishes this in general by simply subtracting the opaque photodetector signal $OP_S$ of the opaque photodetector 49, or an average thereof, from the photodetector signal $P_S$ obtained from the photodetectors 19. In this way, the detected signal $D_S$ will be modified to remove at least some of the effects the x-rays and other factors may have on the detectors 19.

In a further embodiment, the effects of the x-rays on the photodetectors 19 can be decreased by not placing the photodetectors 19 in the image sensing position 9*d*, but rather having a conduit (not shown), such as a fibre optic, to divert light from the image sensing position 9*d*. In this way, the photodetectors 19 can remotely sense the fluorescent light L in the image sensing position 9*d* without being affected by the x-rays.

In a still further embodiment, the detector 19 can indirectly sense the converted medium in the image sensing position 9*d* by sensing the converted medium generated by a corresponding converting device. For example, screens 8*a*, 8*b* and photodetectors 19 may not be placed in the cassette 7, but rather placed in another device, such as a light tight vacuum bag. In a further example, the photodetectors 19 could be constructed in an integral fashion with single or multiple screens 8*a*, 8*b*. In both of these cases, the fluorescent light L emitted by the screens 8*a*, 8*b* would be presumed to correspond to the fluorescent light L that would be sensed by film 9 in the image sensing position 9*d*. The detector 17 could also be constructed in an integral fashion with a single or multiple x-ray conversion device, such as phosphors, Cesium Iodide scintillators or photoconductors, such as amorphous-selenium or lead oxide, made an intrinsic part of the detector 17.

Figure 7:
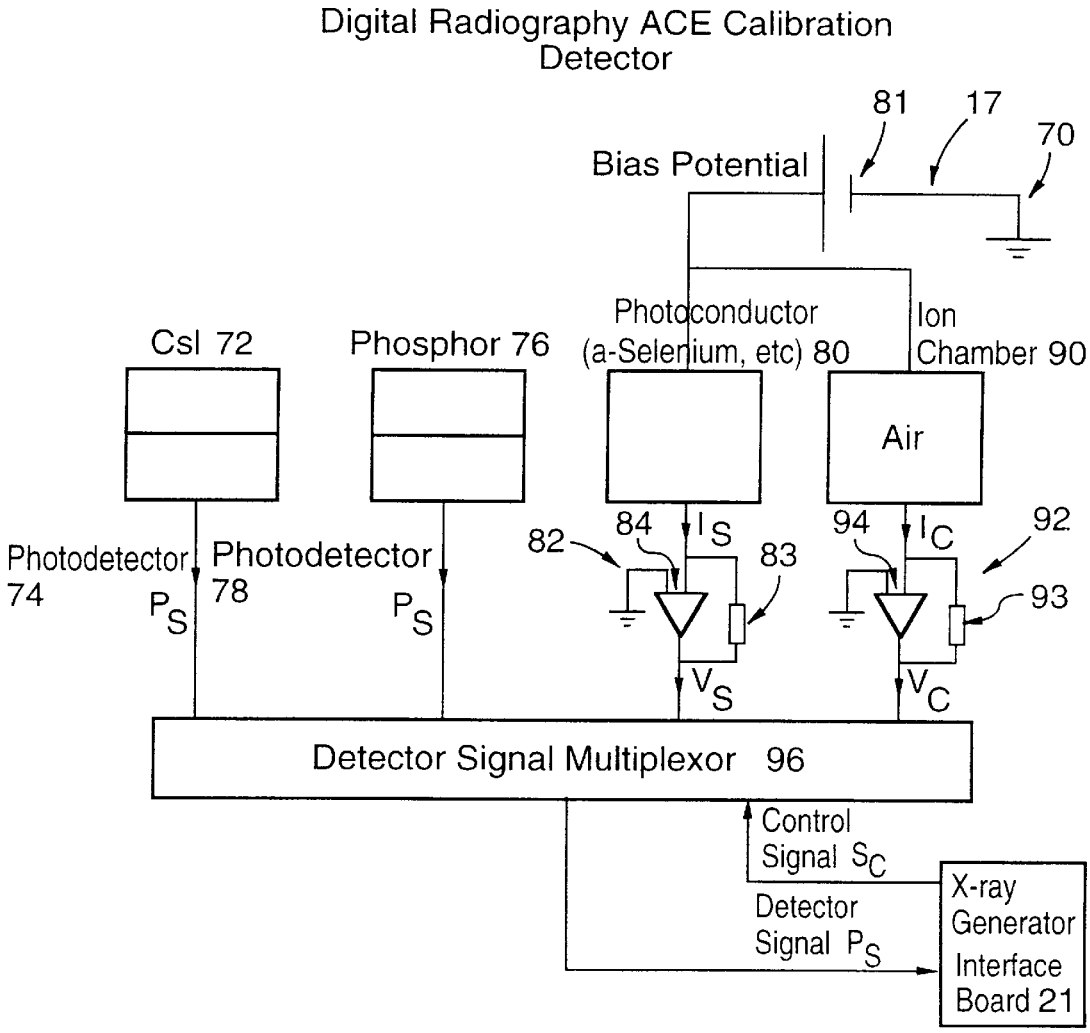
FIG. 7 shows a schematic diagram of a further embodiment of the present invention utilizing a plurality of converting mediums and detectors to measure the converted mediums.

FIG. 7 shows a further embodiment of the present invention where the detector 17 comprises a plurality of detectors 70 which mimic the detection of the converted medium by the corresponding digital detectors. The detectors 70 can comprise a photodetector 74 for detecting light emitted by a Cesium Iodide screen, shown generally by reference numeral 72. The detector 70 can further comprise a photodetector 78 for detecting light emitted from a phosphor screen 76. The photodetectors 74 and 78 will be selected to best detect light emitted by the Cesium Iodide screen 72 and phosphor screen 76, respectively. It is understood that the Cesium Iodide screen 72 and phosphor screen 76 need not form part of the detector 70, but could be included in an integral fashion.

The photodetector signals $P_S$ from the photodetectors 74, 78 are sent to a detector signal multiplexor 96 which forms part of the detector electronics 23 and multiplexes the photodetector signals $P_S$ to produce a detector signal $D_S$ indicative of the light sensed in the image sensing position which is sent to the x-ray generator interface 21. In the embodiment shown in FIG. 7, the detectors 70 can also receive control signals $S_c$ from the x-ray generator interface 21 to control which one of the detectors 70 is to be used and under what parameters.

The detector 70 can further comprise a charge sensitive amplifier, shown generally by reference numeral 82, to detect electrical charges from photoconductors 80, such as amorphous selenium and lead oxide. A DC bias potential 81 is also applied to the photoconductor 80 to collect the electric charge produced by the photoconductor 80. The charge sensitive amplifier 82 can sense the converted medium, in this case the electrical charges, coming from the photoconductor 80. To do so, the charge sensitive amplifier 82 can comprise an operational amplifier 84 and an impedance 83, such as a resistor. The charge sensitive amplifier 82 converts the electrical charges $I_S$ from the photoconductor 80 into a voltage signal $V_S$ which can be detected by the detector signal multiplexor 96 and used to generate the detector signal $D_S$.

In a preferred embodiment, the detector 70 could also comprise an ion chamber 90 which, unlike the photodetectors 74, 78 and the charge sensitive amplifier 82, does not measure a converted medium, but rather measures the x-rays directly and produces an absolute measurement of the x-ray exposure. The ion chamber 90 can comprise air and is biased by bias potential 81. The bias potential 81 for the ion chamber 90 need not be the same as the bias potential 81 used for the photoconductor 80. The ion chamber 90 generates an electric charge $I_C$ which is sent to a charge sensitive amplifier 92. The charge sensitive amplifier 92 can comprise an operational amplifier 94 and impedance 93, such as a resistor, to convert the electric charge $I_C$ from the ion chamber 90 to a voltage signal $V_C$ which can be received by the detector signal multiplexor 96. The detector signal multiplexor 96 then uses the voltage signal $V_C$ to generate the detector signal $D_S$, which, in this case, is indicative of the x-rays, rather than the converted medium.

The ion chamber 96 in essence measures the absolute value of the x-rays leaving the AEC device 6 and prior to impinging on the converting device, such as Cesium Iodide or a photoconductor. Therefore, the ion chamber 90 can be used where the converted medium will produce a proper exposure if the generated x-rays have a corresponding absolute value. The ion chamber 90 cannot be used unless the absolute value of the x-rays for a proper exposure by the converting medium is known.

While the detector 70 has been shown utilizing a plurality of digital detectors 74, 78, 82 and 92, it is understood that detectors 17 can be manufactured utilizing only one of the photodetectors 74, the photoconductor 78 or the charge sensitive amplifier 92 for an ion chamber 90, or any combination of these.

It is understood that, as the present invention has been described with respect to one type of imaging system 10 utilizing one type of AEC device 6, the invention is not limited to this type of x-ray imaging system 10 or AEC device 6. In particular, the present invention can be utilized in imaging systems 10 comprising different types of AEC devices 6, such as solid state AEC devices (not shown). In addition, the present invention can be utilized in different types of x-ray imaging systems 10, in addition to the x-ray imaging system 10 shown in FIG. 1.

It is also understood that while the invention has been described in terms of the detector 17 having detector electronics 23 to generate the detected signals $D_S$, the invention is not limited to this configuration. For example, all of the detector electronics 23 could be self contained and connected directly to a computer (not shown), or, a portion of the electronics of another system (not shown) could be used to assist in processing the photodetector signals $P_S$. For example, the detector electronics 23 could be incorporated into the detector control logic 33 on the generator interface 21, or, contained within the cassette 7 next to the photodetectors 19.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments which are functional, electrical or mechanical equivalents of the specific embodiments and features that have been described and illustrated herein.

The embodiments of the invention in which an exclusive property or privilege is claimed are defined as follows:

1. A device for calibrating an automated exposure control (AEC) device in an x-ray imaging system, said AEC device generating an AEC output signal and said x-ray imaging system comprising an x-ray generating device for generating x-rays and screen means for converting x-rays into light which can be sensed by photosensitive films in an image sensing location, said device for calibrating comprising:

photodetector means for detecting light in the image sensing location and generating a detector signal indicative of the light being detected;

determining means for receiving the detector signal and the AEC output signal and determining if the detector signal corresponds to a desired detector output; and wherein the photodetector means detects light generated by the screen means when the x-ray generating device is generating x-rays;

wherein, for a first set of predetermined conditions of the imaging system, the x-ray generating device generates x-rays and the determining means determines a first target AEC output which corresponds to the AEC output signal which is generated by the AEC device when the detector signal corresponds to the desired detector output; and wherein the first target AEC output corresponds to the AEC output signal for a proper exposure of photosensitive films when the imaging system has the first set of predetermined conditions.

2. The device as claimed in claim 1 wherein the photodetector means comprises at least one photodetector for detecting the light emitted by the screen means and wherein the detector signal is indicative of the light being detected by the at least one photodetector.

3. The device as claimed in claim 2 wherein the photodetector means comprises at least one opaque photodetector which is insensitive to light and is near the at least one photodetector to detect effects of the x-rays; and wherein the opaque photodetector generates an opaque photodetector signal indicative of the effects of the x-rays on the at least one photodetector means and the photodetector means accounts for the opaque photodetector signal when generating the detector signal.

4. The device as claimed in claim 1 wherein the screen means comprises two phosphor screens and the photodetector means comprises at least two photodetectors, each photodetector detecting the light emitted by a corresponding one of the two phosphor screens;

wherein each photodetector generates a photodetector signal indicative of the light emitted by the corresponding phosphor screen and the photodetector means averages the photodetector signals to generate the detector signal.

5. The device as claimed in claim 1 wherein the screen means comprises two phosphor screens and the photodetector means comprises at least two photodetectors, each photodetector detecting the light emitted by a corresponding one of the two phosphor screens;

wherein each photodetector generates a photodetector signal indicative of the light emitted by the corresponding phosphor screen and the detector signal comprises each of the photodetector signals.

6. The device as claimed in claim 2 wherein the desired detector signal is determined by placing a first film having an attenuation filter with known transmissivities fixed thereto in the image sensing position, causing the x-ray generating device to generate x-rays and comparing the optical density of the first film for different known transmissivities to determine a desired transmissivity for a desired optical density and modifying the detector signal from the at least one photodetector exposed to a similar x-ray exposure by the desired transmissivity to determine the desired detector signal.

7. The device as claimed in claim 6 wherein the known transmissivity of the attenuation filter is modified to an effective transmissivity which accounts for reflection of light within the cassette.

8. The device as claimed in claim 1 further comprising storing means for storing said first target AEC output as a target AEC output for a proper exposure of a photosensitive film when the imaging system has the first set of predetermined conditions.

9. The device as claimed in claim 8 wherein for a second set of predetermined conditions of the imaging system, the x-ray generating device generates x-rays and the determining means determines a second target AEC output signal which corresponds to the AEC output signal which is generated by the AEC device when the detector signal corresponds to the desired detector output and the x-ray imaging system has the second set of predetermined conditions; and wherein said storing means stores the second target AEC output signal as the target AEC output for a proper exposure of a photosensitive film when the imaging system has the second set of predetermined conditions.

10. The device as claimed in claim 9 wherein for each of a plurality of sets of predetermined conditions, the x-ray generator successively generates x-rays and the determining means determines target AEC signals for each set of predetermined conditions, each of said target AEC signals corresponding to the AEC output signal which is generated by the AEC device when the detector signal corresponds to the desired detector output for a corresponding one of the plurality of sets of predetermined conditions; and wherein said storing means stores each of the target AEC signals as the target AEC output for a proper exposure of a photosensitive film when the imaging system has the corresponding one of the plurality of sets of predetermined conditions.

11. In an x-ray imaging system comprising an x-ray generating device to generate x-rays, an automated exposure control (AEC) device having x-ray detector means for detecting x-rays and generating an AEC output indicative of the x-rays detected, and converting means for converting x-rays to a converted medium which can be sensed by image sensing means when in an image sensing location, a method for calibrating said AEC device comprising the steps of:

(a) generating x-rays with said x-ray generator when the imaging system has a first set of predetermined conditions;

(b) detecting the converted medium in the image sensing location and generating a detector signal indicative of the converted medium being detected in the imaging sensing location;

(c) determining when the detector signal corresponds to a desired detector output; and (d) determining a target AEC output for the first set of predetermined conditions corresponding to the AEC output when the detected output corresponds to the desired detector output.

12. The method as claimed in claim 11 further comprising the steps of:

(e) repeating steps (a), (b), (c) and (d) for each of a plurality of sets of predetermined conditions to determine a target AEC output for a corresponding one of the plurality of sets of predetermined conditions; and (f) storing each of the target AEC outputs and the corresponding one of the plurality of sets of predetermined conditions as a target AEC output signal which should be generated by the AEC device for a proper exposure of the image sensing means in the image sensing position when the image sensing system has the corresponding one of the plurality of sets of predetermined conditions.

13. The method as claimed in claim 12 further comprising the step of:

determining the desired detector output by (i) affixing an attenuation means to a first image sensing means for attenuating the converted medium by known attenuations;

(ii) placing the first image sensing means with the attenuation affixed thereto in the image sensing position;

(iii) generating x-rays with the x-ray generator for an x-ray exposure;

(iv) detecting the converted medium in the image sensing location and generating a corresponding detector signal indicative of the converted medium being generated in the imaging location during an exposure similar to the x-ray exposure;

(v) comparing the attenuations sensed on the first image sensing means with the corresponding detector signal to determine the desired detector signal that corresponds to a desired x-ray image exposure of the image sensing means; and (vi) storing the detector signal that corresponds to the desired x-ray image exposure as the desired detector output.

14. The method as claimed in claim 12 wherein the image sensing means is a photosensitive film, the converting means comprises phosphor screens and the converted medium is light.

15. The method as claimed in claim 12 wherein the image sensing means is a thin film transistor active matrix means having light sensing means, the converting means is selected from a group consisting of phosphor screens and Cesium Iodide screens and the converted medium is light.

16. The method as claimed in claim 12 wherein the image sensing means comprises a means to sense electrical charges, the converting means is a selenium receptor and the converted medium is electrical charge.

17. In an x-ray imaging system comprising an x-ray generating device to generate x-rays, an automated exposure control (AEC) device having x-ray detector means for detecting x-rays and generating an AEC output signal indicative of the x-rays detected, and converting means for converting x-rays into a converted medium which can be sensed by image sensing means in an image sensing location, a device for calibrating said AEC device comprising:

detector means for detecting the converted medium in said image sensing location and generating a detector signal indicative of the converted medium being detected in the image sensing position; and determining means for receiving the detector signal and the AEC output signal and determining a first target AEC output signal for a first set of conditions of the imaging system by determining the AEC output signal when the detector output corresponds to a desired detector output and the x-ray imaging system has the first set of conditions.

18. The device as claimed in claim 17 further comprising storing means for storing said first target AEC output as a target AEC output for a proper exposure of an image sensing means when the imaging system has the first set of predetermined conditions.

19. The device as claimed in claim 18 wherein for each of a plurality of sets of predetermined conditions, the x-ray generating device successively generates x-rays and the determining means determines target AEC signals for each set of predetermined conditions, each of said target AEC signals correspond to the AEC output signal which is generated by the AEC device when the detector signal corresponds to the desired detector output for a corresponding one of the plurality of sets of predetermined conditions; and wherein said storing means stores each of the target AEC signals as the target AEC output for a proper exposure of an image recording means when the imaging system has the corresponding one of the plurality of sets of predetermined conditions.

20. The device as claimed in claim 18 wherein the image sensing means is selected from the group consisting of thin film transistor active matrix means having light sensing means and diode switching arrays, the converting means is selected from a group consisting of phosphor screens and Cesium Iodide screens, the converted medium is light and the detector means is a photodetector.

21. The device as claimed in claim 18 wherein the image sensing means comprises a means to sense electrical charges, the converting means is a photoconductor selected from the group consisting of amorphous selenium and lead oxide, the converted medium is electrical charge and the detector means is a charge sensitive amplifier.

22. The device as claimed in claim 18 wherein the detector means comprises a charge sensitive amplifier to detect electrical charges from a photoconductor and photodetectors to detect light generated by converting means selected from a group comprising phosphor screens and Cesium Iodide screens.

* * * * *